US010344682B1

(12) United States Patent
Vandenberg

(10) Patent No.: US 10,344,682 B1
(45) Date of Patent: Jul. 9, 2019

(54) ENGINE VALVE SHAFT WITH FLOW PASSAGES FOR INTAKE AND EXHAUST CONTROL

(71) Applicant: Andre H Vandenberg, Krum, TX (US)

(72) Inventor: Andre H Vandenberg, Krum, TX (US)

( * ) Notice: Subject to any disclaimer, the term of this patent is extended or adjusted under 35 U.S.C. 154(b) by 0 days.

(21) Appl. No.: 15/406,615

(22) Filed: Jan. 13, 2017

(51) Int. Cl.

| | |
|---|---|
| ***F01L 1/06*** | (2006.01) |
| ***F01L 7/02*** | (2006.01) |
| ***F02D 13/02*** | (2006.01) |
| ***F01L 13/00*** | (2006.01) |
| ***F01L 9/04*** | (2006.01) |
| ***F02P 5/145*** | (2006.01) |
| ***F02B 75/02*** | (2006.01) |
| ***F01L 1/36*** | (2006.01) |

(52) U.S. Cl.
CPC ..... *F02D 13/0219* (2013.01); *F01L 1/06* (2013.01); *F01L 1/36* (2013.01); *F01L 7/026* (2013.01); *F01L 9/04* (2013.01); *F01L 13/0005* (2013.01); *F01L 13/0015* (2013.01); *F02B 75/02* (2013.01); *F02P 5/145* (2013.01)

(58) Field of Classification Search
CPC ..... F01L 1/38; F01L 1/36; F01L 1/06; F01L 1/04; F01L 1/443; F01L 1/185; F01L 1/022; F01L 1/024; F01L 1/046; F01L 1/344; F01L 7/026; F01L 7/16; F01L 7/10; F01L 7/02; F01L 7/18; F01L 13/0057; F01L 13/0015; F01L 13/0005; F01L 13/0036; F01L 2013/001; F01L 9/04; F01L 15/14; F01L 2113/00; F02P 5/145; F02B 75/02; F02B 75/021; F02B 2075/027; F02B 2075/022; F02B 2075/025; F02D 13/0219; F02D 13/06; F02D 41/0087
See application file for complete search history.

(56) References Cited

U.S. PATENT DOCUMENTS

| | | | | |
|---|---|---|---|---|
| 1,724,458 | A * | 8/1929 | Davidson | F01L 7/022 123/190.6 |
| 4,509,488 | A | 4/1985 | Forster et al. | |
| 4,572,118 | A | 2/1986 | Baguena | |
| 4,593,658 | A | 6/1986 | Moloney | |
| 4,762,095 | A | 8/1988 | Mezger et al. | |
| 4,841,923 | A | 6/1989 | Buchl | |

(Continued)

*Primary Examiner* — George C Jin
(74) *Attorney, Agent, or Firm* — Mark Handley; Handley Law Firm, PLLC

(57) ABSTRACT

An internal combustion engine (10) with variable valve timing has one or more valve shafts (38, 44) connected to stepper motors (54) for angularly positioning the one or more valve shafts (38, 44) relative to an engine block (12). Flow passages (50, 52) are formed into the one or more valve shafts (38, 44) for passing intake air and exhaust gases into and from the engine (10). Sensors (58, 60 and 62) are located adjacent a crankshaft (28) and the one or more valve shafts (38, 44) for determining crankshaft positions and valve shaft positions relative to the engine block (12). An engine control unit (56) receives crank shaft and valve shaft position signals and emits control signals to the stepper motors (54) to selectively operate the engine in two stroke, four stroke, six stroke, eight stroke, and ten stroke modes. Electrically controlled clutches (74 and 76) are mounted to respective ones of the crankshaft (28) and the valve shafts (38, 44), and connected by a timing chain (72) for actuating to provide backup valve shaft.

17 Claims, 5 Drawing Sheets

(56) References Cited

U.S. PATENT DOCUMENTS

| | | | | |
|---|---|---|---|---|
| 4,846,120 | A | 7/1989 | Buchl | |
| 4,867,111 | A | 9/1989 | Schneider et al. | |
| 4,870,930 | A | 10/1989 | Yagi | |
| 4,883,025 | A | 11/1989 | Richeson, Jr. | |
| 4,976,227 | A * | 12/1990 | Draper | F01L 7/026 123/190.1 |
| 5,161,494 | A | 11/1992 | Brown, Jr. | |
| 5,331,931 | A | 7/1994 | Blish et al. | |
| 5,377,631 | A | 1/1995 | Schechter | |
| 5,404,770 | A | 4/1995 | Kruger | |
| 5,408,966 | A | 4/1995 | Lipinski et al. | |
| 5,778,858 | A | 7/1998 | Garabedian | |
| 5,826,563 | A | 10/1998 | Patel et al. | |
| 6,250,283 | B1 | 6/2001 | Russell et al. | |
| 6,443,116 | B1 * | 9/2002 | Dahlborg | F01L 7/02 123/190.2 |
| 6,600,989 | B2 | 7/2003 | Sellnau et al. | |
| 7,146,966 | B2 * | 12/2006 | Nakamura | F01L 1/185 123/481 |
| 7,523,728 | B2 | 4/2009 | Berndorfer | |
| 8,667,938 | B2 | 3/2014 | von Mayenburg | |
| 8,701,628 | B2 | 4/2014 | Tripathi et al. | |

* cited by examiner

ENGINE VALVE SHAFT WITH FLOW PASSAGES FOR INTAKE AND EXHAUST CONTROL

TECHNICAL FIELD OF THE INVENTION

The present invention relates in general to internal combustion engines, and in particular to an internal combustion engine having valve shaft with flow passages which is electronically controlled to provide camshaft-like function for control of engine intake and exhaust from the engine.

BACKGROUND OF THE INVENTION

Internal combustion engines such as those used in the automotive industry typically have one or more camshafts which open and close intake and exhaust valves for passing air and exhaust gasses to and from one or more combustion chambers. A rotary shaft is connected to displacement members such as pistons or rotors which are moveably disposed for determining the volume of corresponding combustion chambers. Timing belts and timing chains have been used for connecting rotary shafts to respective camshafts to provide cam timing so that the intake and exhaust valves will be opened and closed in cooperative relation with displacement members moving within combustion chambers.

Application of electronics to modern internal combustion engines has resulted in electronic control of engine functions, from electronic ignition timing, to throttle control and fuel injection. Timing belts and timing chains in some prior art engines have been replaced by stepper motors controlling cam timing for opening and closing conventional intake and exhaust valves. In some prior art piston engines energy is conserved by skipping operation of predetermined cylinders when engine power requirements are low, and then all cylinders may be used when engine power requirements are high. Fuel will not be injected into cylinders when not being used. This has caused harmful engine deposits to buildup when the same preselected cylinders are continuously not used in lower power modes and are especially troublesome for conventional valves. For skipped cylinder combustion engines in which carburetors are used, emissions are increased since fuel that would normally be burned during combustion is now emitted to the atmosphere as a gas when a particular cylinder is skipped.

SUMMARY OF THE INVENTION

An internal combustion engine is disclosed having variable valve timing. The engine has an engine block into which is formed a plurality of combustion chambers and a cylinder head. A crankshaft is rotatably secured to the engine block for transferring rotary power therefrom. A valve shaft is rotatably secured to the cylinder head and the engine block for angularly moving relative to the crankshaft and the engine block to define cam timing functions for controlling intake and exhaust from the engine. The valve shaft is preferably formed into an elongate cylindrical shape having a longitudinal axis about which the valve shaft rotates. Intake and exhaust flow passages extend through the valve shaft in transverse relation to the longitudinal axis. A stepper motor is provided for rotating the valve shaft into selected angular positions. The valve shaft is angularly positioned to align respective ones of the intake and exhaust flow passages with the engine intake and exhaust ports for passing intake air and exhaust gases into and from respective ones of the engine intake and exhaust ports. Preferably, respective ones of the intake and exhaust flow passages are disposed in angularly spaced apart alignment relative to the longitudinal axis of the valve shaft, such as fifteen degree to ninety degree spacings. In some embodiments, a single valve shaft may have both intake and exhaust ports. In other embodiments separate intake valve shafts and exhaust valve shafts may be used.

Sensors are located relative to the crankshaft and the valve shaft for determining crankshaft angular positions and valve shaft angular positions relative to the engine block. An engine control unit ("ECU") is connected to the sensors for receiving angular position signals from the sensors and emitting control signals to the stepper motor which in response thereto moves the valve shaft into selected angular positions relative to the engine block. In the selected angular positions the intake and exhaust flow passages of the valve shaft are selectively aligned for registering with the engine intake and exhaust, respectively, to pass air and exhaust gas flow into engine combustion chambers. The stepper motor will also move the valve shaft from the selectively aligned positions to block air and exhaust gas flow into the engine combustion chambers. Seal grooves are formed into the valve shaft to circumferentially extend around respective ones of the intake and exhaust flow passages, and, when the intake and exhaust flow passages are aligned with the engine intake and exhaust, the seal grooves are disposed to extend between the cylinder head and the valve shaft. The seal grooves prevent air and exhaust flow between the valve shaft and the cylinder head in regions adjacent to the flow passages.

The electronic control unit is configured to selectively operate only part of the combustion chambers at low power settings. During low power conditions the electronic control unit emits control signals which align only part of the intake flow passages with the engine intake ports of the part of the combustion chambers used at low power settings. The electronic control unit will not align selected ones of the intake flow passages with the engine intake ports for the combustion chambers not being utilized for combustion during lower power settings. The electronic control unit also controls fuel injection into the combustion chambers, and emits control signals to inject fuel into the part of the combustion chambers used at low power settings and does not inject fuel into selected ones of the combustion chambers not being utilized for combustion during lower power settings. The electronic control unit controls ignition in the engine and emits signals which cause combustion to occur for the part of the combustion chambers used at low power settings and combustion to not occur for selected ones of the combustion chambers not being utilized for combustion during lower power settings. Preferably, the electronic control unit selectively causes combustion to occur in the combustion chambers such that at mid-range power levels the engine operates in four stroke mode, at low power levels the engine operates in multi-stroke mode greater than four strokes, and at high power levels the engine operates in two stroke mode, equally utilizing each of the cylinders for combustion in each of the modes. Preferably, in four stroke mode the valve shaft which provides cam shaft function will rotate with an angular velocity which is one-half the angular velocity at which the crank shaft rotates. In two stroke mode the valve shaft will rotate with an angular velocity which is equal to the angular velocity at which the crank shaft rotates. In eight stroke mode the valve shaft will rotate with an angular velocity which is one-fourth the angular velocity at which the crank shaft rotates. Similarly, the valve shaft will rotate with an angular velocity which is proportional to the angular velocity at which the crank shaft rotates for six stroke mode, ten stroke mode, twelve stroke mode, and other modes.

At least one electrically controlled clutch is mounted to one of the rotary shaft and the valve shaft and connected by a timing chain to the other of the crankshaft and the valve shaft. The electrically controlled clutch is actuated to provide camshaft timing in alternative to the electronic control unit and the stepper motor. Two clutches may be provided such that a timing chain extending between the two clutches will remain stationary until required for use.

DESCRIPTION OF THE DRAWINGS

For a more complete understanding of the present invention and the advantages thereof, reference is now made to the following description taken in conjunction with the accompanying Drawings in which

FIG. 1 is a schematic side elevation, cutaway view of the internal combustion engine showing one of the rotary valve shafts;

FIG. 2 is a vertical section view of part of the internal combustion engine, taken along section line 2-2 of FIG. 1, showing the rotary valve shafts, the cylinder head, and an engine block;

FIG. 3 is a sectional view of a portion of the internal combustion engine, taken along section line 3-3 of FIG. 2;

FIG. 4 is a sectional view of the portion of the internal combustion engine, taken along section line 4-4 of FIG. 3;

FIG. 5 is a schematic side elevation, cutaway view of a second internal combustion engine having a single rotary valve shaft with intake ports and exhaust ports;

FIG. 6 is a sectional view of part of the second engine, taken along section line 6-6 of FIG. 5;

FIG. 7 is a sectional view of a portion of the second engine, taken along section line 7-7 of FIG. 6;

FIG. 8 is a sectional view of a seal for sealing between the cylinder head and one of the valve shafts;

FIG. 9 is a side view of one of the valve shaft ports having plurality of seal grooves concentrically disposed about the valve shaft port.

DETAILED DESCRIPTION OF THE INVENTION

Figure 1:
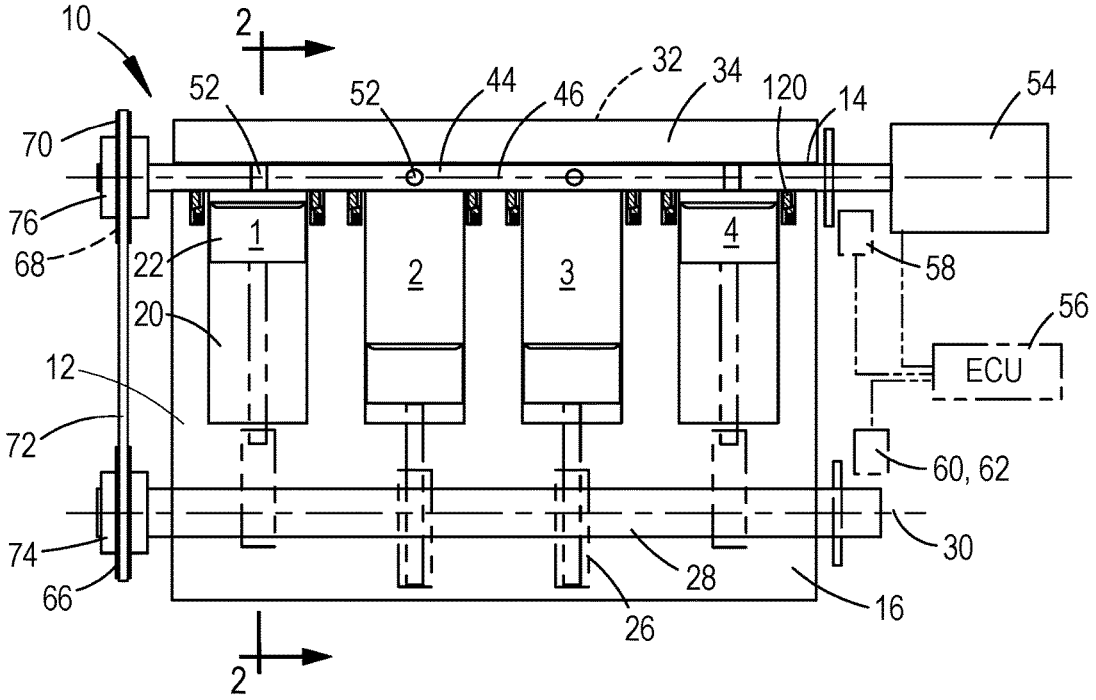
FIGS. 1 through 9 show various aspects for an internal combustion engine having variable valve timing provided by rotary valve shafts with flow passages for intake and exhaust control, as set forth below.

FIG. 1 is a side elevation, cutaway view of an internal combustion engine 10 having variable engine valve timing features. The engine 10 has an engine block 12, a cylinder head 14 and a crank case 16. A plurality of cylinders 20 are disposed in the block 12, and are designated cylinders 1, 2, 3 and 4. Pistons 22 are slidably disposed within the cylinders 20 to define combustion chambers. Each of the pistons 22 is connected by the crank arms 26 to the crankshaft 28. The crankshaft 28 has a longitudinal axis 30 and defines a power shaft for providing rotary mechanical power output from said engine 10. An intake manifold 32 and exhaust manifold 34 are mounted atop the cylinder head 14, with only the intake manifold 32 shown in FIG. 1. A valve shaft 38 and a second valve shaft 44 are mounted to the cylinder head 14, spaced apart and having longitudinal axes 40 and 46 which extend in parallel longitudinally along the top of the block 12. The valve shafts 38 and 44 are preferably rotatably mounted within recesses 42 and 48, respectively, and are formed into the cylinder head 14 and extend along the top of the cylinders 20. The valve shaft 38 has a plurality of intake ports 50 which are spaced apart in a longitudinal direction. The intake ports 50 which are disposed above the cylinders 1 and 4 are aligned in parallel and the intake ports 50 which are disposed above the cylinders 2 and 3 aligned in parallel. The intake ports 50 located above the cylinders 1 and 4 are preferably disposed perpendicular to the intake ports 50 which are location above the cylinders 2 and 3. Similarly, the valve shaft 44 has a plurality of exhaust ports 52 which are spaced apart in a longitudinal direction, with exhaust ports 52 located above the cylinders 1 and 4 preferably aligned in parallel, and the exhaust ports 52 located above cylinders 2 and 3 preferably aligned in parallel. The exhaust ports 52 located above the cylinders 1 and 4 are preferably disposed perpendicular to the exhaust ports 52 which are location above the cylinders 2 and 3. The intake ports 50 and the exhaust ports 52 provide flow passages formed into respective ones of the valve shafts 38 and 44. Two stepper motors 54 are provided, one connected to each of the valve shafts 38 and 44. In other embodiments, one stepper motor 54 may be provided to control two valve shafts 38 and 44 by means of coupling to the two shafts 38 and 44 with timing belts, timing chains, gears, or a combination thereof.

An engine control unit ("ECU") 56 controls operation of the stepper motors 54, which controls angular positioning of the valve shafts 38 and 44 for mechanically timing opening and sealing of the intake ports 50 and the exhaust ports 52 for each of the respective cylinders 14. Position sensors 58, 60 and 62 are provided for sensing positions of the crankshaft 28 and the valve shafts 38 and 44, respectively. The position sensors 58, 60 and 62 emit electronic signals indicating angular positions of the crankshaft 28 and the valve shafts 38 and 44 which are received by the ECU 56. In response to the signals from the position sensors 58, 60 and 62, the ECU will emit control signals to the stepper motors 54, positioning the valve shafts 38 and 44 in cooperative relation to the crankshaft 28 for timing intake and exhaust from the cylinders 20 to provide camshaft-like timing functions for operation of the engine 10.

To provide an alternate valve shaft timing system as backup in case of failure of the stepper motor 54 and the ECU 56, a crank gear 66 is mounted to the forward end of the crankshaft 28 with a clutch 74. Two clutches 76 are used to mount two valve shaft sprockets 68 and 70 to the forward ends of the valve shafts 38 and 44, respectively. A timing chain 72 extends between the crank gear 66 and both of the valve shaft sprockets 68 and 70. As an the alternative, a second crank gear 66 and two of the timing chains 72 will be provided to extend between respective ones of the crank gears 66 and the valve shaft sprockets 68 and 70. The clutches 74 and 76 are preferably electrically actuated to mechanically engage the crank gears 42 to the crankshaft 28 and the sprockets 68 and 70 to the valve shafts 38 and 44. The clutches 74 and 76 are preferably cone-type clutches which are keyed such that when engaged the valve shafts 38 and 44 will be mechanically timed for synchronized operation with the crankshaft 28 should failure be encountered for either of the stepper motors 54, the ECU 56, or the position sensors 58, 60 and 62. In some embodiments, the timing chains 72 may be replaced by timing belts and accordingly the crank gear 66 and the valve shaft sprockets 68 and 70 replaced by timing belt pulleys. The timing chains 72 are used to provide mechanical valve timing only when the ECU 56 and stepper motors 54 have failed or have been disabled, and will normally not be used.

Figure 2:
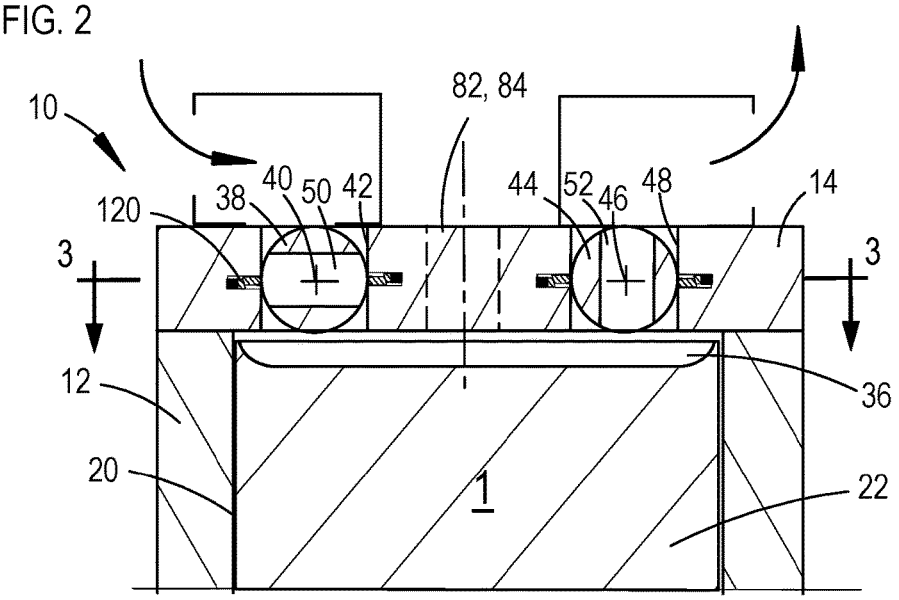

FIG. 2 is a vertical section view of the engine 10 taken along section line 2-2 of FIG. 1, and shows the engine block 12, the cylinder head 14, the cylinder 20 and the valve shafts 38 and 44. Valve shafts 38 and 44 are shown in spaced apart relation extending through the cylinder head 14. Recesses 42 and 48 are provided in the cylinder head 14 and preferably extend parallel to the longitudinal axis of 30 for receiving the valve shafts 38 and 44. The recesses 42 and 48 are shown with square shaped cross-sections, but may also be formed to have other shapes such as circular shaped cross-sections. The valve shafts 38 and 44 are rotatably mounted to the cylinder head 14 in respective ones of the recesses 42 and 48. The valve shaft 38 is shown with the intake ports 50 (one shown in FIG. 2) located in closed positions, with the intake port 50 extending from sidewall to sidewall of the recess 42 in the cylinder head 14 such that intake air will not pass from intake manifold 32, through the intake port 40 shown and into the cylinder 20. The valve shaft 44 is shown having been rotated to locate the exhaust ports 52 (one shown in FIG. 2) in open positions, with the exhaust port 52 shown vertically aligned for passing air from the cylinder 20 through the exhaust port 52 and into the exhaust manifold 34. At a later time, the valve shafts 38 and 44 may be rotated such that the cylinder 20 is fully sealed, and then rotated again, such that the intake valve shaft 38 is moved to vertically align the intake port 50 for passing intake air from the intake manifold 32 into the cylinder 20 and the exhaust valve shaft 40 is moved to align the exhaust port 52 to a position preventing passage of exhaust gases from the cylinder 20, through the exhaust port 52, and into the exhaust manifold 34.

Figure 3:
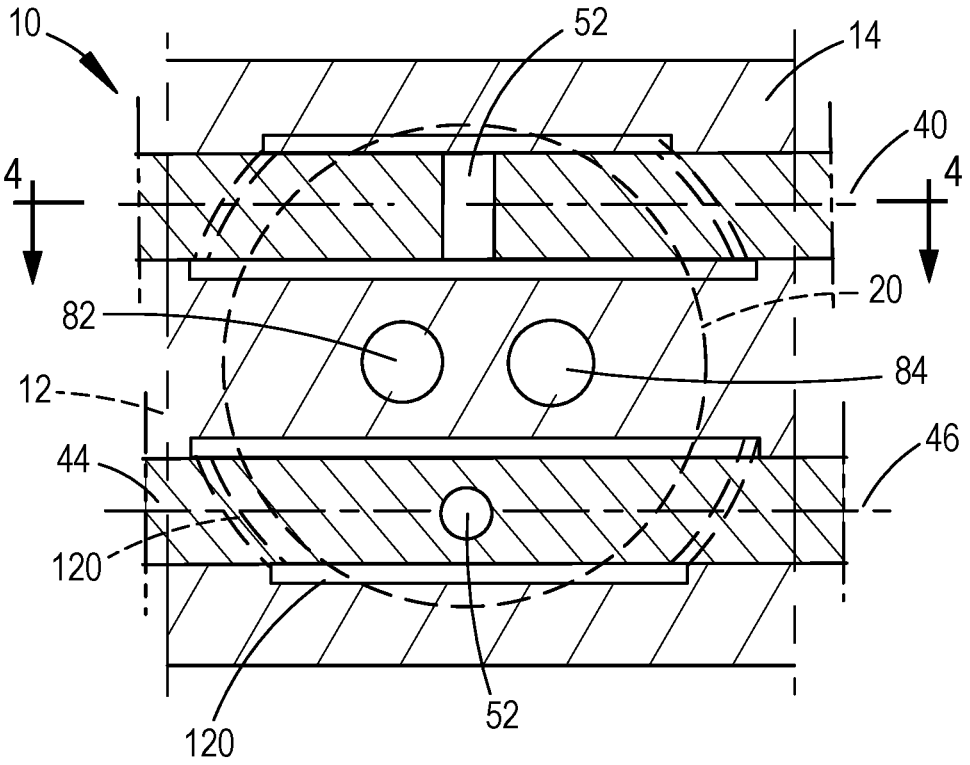

FIG. 3 is a sectional view of a portion of the engine 10 taken along section line 3-3 of FIG. 2 the plane of which cuts through the cylinder head 14. One of the cylinders 20 in the engine block 12 is represented as a hidden line beneath the head 14. The two valve shafts 38 and 44 are shown extending in the cylinder head 14, rotatably mounted to the head 14 (bearings not shown). The valve shafts 38 and 44 have longitudinal axes 40 and 46 which preferably are spaced apart and extend in parallel. The longitudinal axes 40 and 46 are preferably disposed parallel to the longitudinal axis 30 of the crank shaft 28. A fuel injector port 82 and a spark plug port 84 are shown extending through the head 14, aligned in a spaced apart relation and disposed between the two valve shafts 38 and 44. The intake port 50 and the exhaust port 52 are shown extending transversely through respective ones of the valve shafts 38 and 44, preferably at right angles to the longitudinal axes 40 and 46. The intake port 50 is shown as being moved aside from being in fluid communication with the cylinder 20 and the exhaust port 52 is shown in fluid communication with the cylinder 20.

Figure 4:
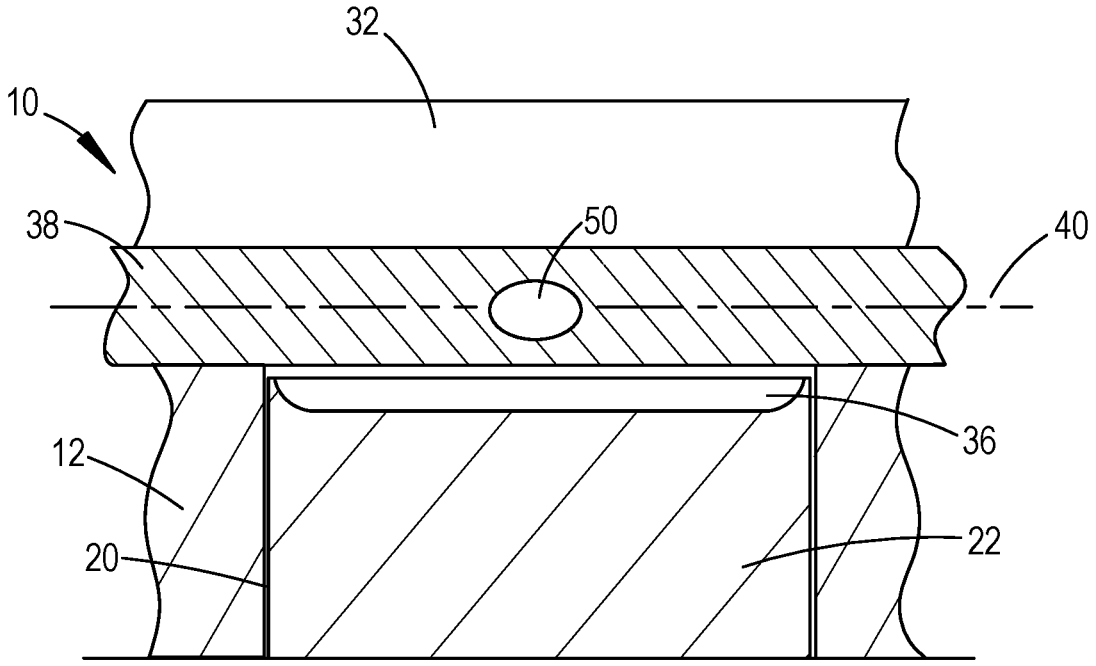

FIG. 4 is a vertical section view of the engine 10 taken along section line 4-4 of FIG. 3, and shows the valve shaft 38 extending through the cylinder head 14. The valve shaft 38 has been rotated to a closed position, such that the intake port 50 is not in fluid communication between the cylinder 20 and the intake manifold 32.

Figure 5:
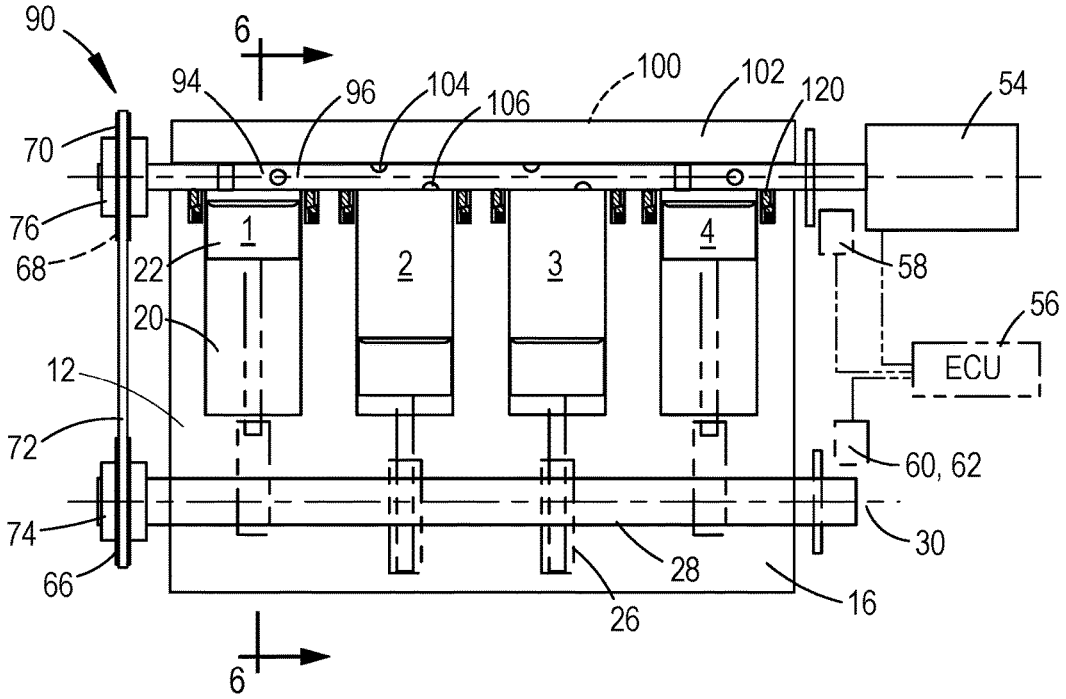

FIG. 5 is a side elevation, cutaway view of a second internal combustion engine 90 which has the engine block 12, a cylinder head 92 and the crank case 16. A plurality of the cylinders 20 are disposed in the block 12, and are designated cylinders 1, 2, 3 and 4. The pistons 22 are slidably disposed within the cylinders 20 to define combustion chambers. Each of the pistons 22 is connected by the crank arms 26 to the crankshaft 28. The crankshaft 28 defines a power shaft for providing rotary mechanical power output from said engine 90. An intake manifold 32 and exhaust manifold 34 are mounted atop the cylinder head 92, with only the exhaust manifold 32 shown in FIG. 5. The engine 90 has a single valve shaft 94 which is rotatably mounted to the cylinder head 92 and which extends along the top of the cylinders 20. The valve shaft 94 is ported to have both intake ports 104 and exhaust ports 106, preferably one of each for each of the cylinders 20. The intake ports 104 and exhaust ports 106 are spaced apart in a longitudinal direction along a longitudinal axis 96 of the valve shaft 94, with intake ports 104 and exhaust ports 106 paired for a particular, single one of the cylinders 20 and the ports 104, 106 of respective pairs aligned in perpendicular relation. Preferably, the intake ports 104 for cylinders 1 and 4 are parallel, and exhaust ports 106 for cylinders 1 and 4 are parallel. Similarly, the intake ports 104 for cylinders 2 and 3 are parallel, and exhaust ports 106 for cylinders 2 and 3 are parallel. Preferably, the intake ports 104 for cylinders 1 and 4 are angularly offset from the intake ports 104 for cylinders 2 and 3 by forty-five degrees about the longitudinal axis 96, and similarly, the exhaust ports 106 for cylinders 1 and 4 are angularly offset from the exhaust ports 106 for cylinders 2 and 3 by forty-five degrees about the longitudinal axis 96. This allows for selective alignment of the various intake ports 104 and exhaust ports 106 to provide mechanical timing for synchronizing intake and exhaust for the cylinders 20 with the pistons 22 and the crankshaft 28. The intake ports 104 and the exhaust ports 106 provide flow passages formed into the valve shaft 94.

One stepper motor 54 is connected to the valve shaft 94 for operating in conjunction with the ECU 56 to control mechanical timing the single valve shaft 94 in synchronization with the crankshaft 28. The engine control unit ("ECU") 56 controls operation of the stepper motor 54, which angularly positions of the valve shaft 94 for timing opening and sealing of the intake ports 104 and the exhaust ports 106. Position sensors 58 and 60 are provided for sensing positions of the crankshaft 28 and the valve shaft 94, respectively. The position sensors 58 and 60 emit electronic signals indicating angular positions of the crankshaft 28 and the valve shaft 94 which are received by the ECU 56. In response to the signals from the position sensors 58 and 60 the ECU 56 will emit control signals to the stepper motor 54, positioning the valve shaft 94 in cooperative relation to the crankshaft 28 for timing intake and exhaust from the cylinders 20 to provide camshaft-like timing functions for operation of the engine 90. Preferably, the electronic control unit selectively causes combustion to occur in the combustion chambers such that at mid-range power levels the engine operates in four stroke mode, at low power levels the engine operates in multi-stroke mode greater than four strokes, and at high power levels the engine operates in two stroke mode, equally utilizing each of the cylinders for combustion in each of the modes. For the different modes, the valve shaft will preferably rotate with an angular velocity which is proportional to the angular velocity at which the crank shaft rotates. In two stroke mode the valve shaft will rotate with an angular velocity which is equal to the angular velocity at which the crank shaft rotates. In four stroke mode the valve shaft will rotate with an angular velocity which is one-half the angular velocity at which the crank shaft rotates. In eight stroke mode the valve shaft will rotate with an angular velocity which is one-fourth the angular velocity at which the crank shaft rotates. Similar proportions between the valve shaft angular velocity and the crank shaft angular velocity are established for six stroke mode, ten stroke mode, twelve stroke mode, and other modes.

As a backup in case of failure of the ECU 56 and the stepper motor 54, a crank gear 66 is mounted to the forward end of the crankshaft 28 by a clutch 74, and a valve shaft sprocket 68 is mounted by a clutch 76 to the forward end of the valve shaft 94, respectively. A timing chain 38 extends between the crank gear 66 and the valve shaft sprocket 68. The clutches 74 and 76 are preferably electrically actuated to mechanically engage the gear 66 to the crankshaft 28 and the sprocket 68 to the valve shaft 94. The clutches 74 and 76 are preferably keyed such that when engaged the valve shaft 94 will be mechanically timed for proper synchronized operation with the crankshaft 28 should failure be encountered for either the stepper motor 54, the ECU 56, or the position sensors 58 and 60. In some embodiments, the timing chain 72 may be replaced by a timing belt and accordingly the crank gear 66 and the valve shaft sprocket 68 replaced by timing belt pulleys. The timing chain 72 are for use only when the ECU 56 and stepper motor 54 timing function has failed or has been disabled, and will normally not be used.

Figure 6:
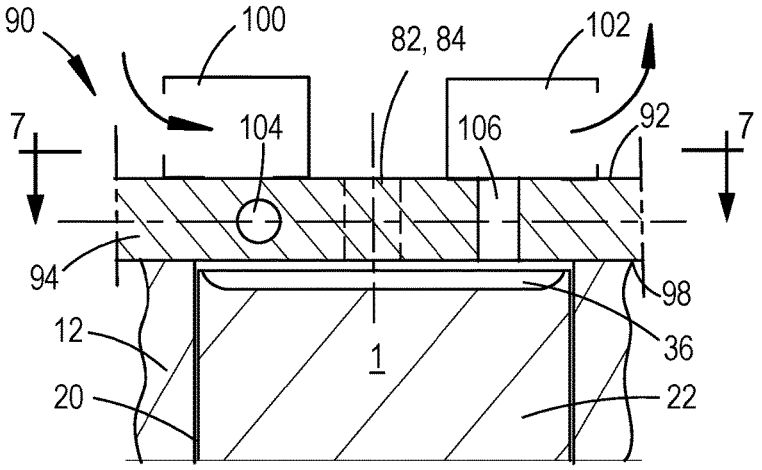

FIG. 6 a vertical section view of the engine 90 taken along section line 6-6 of FIG. 5, and shows the engine block 12, the cylinder head 92, the cylinder 20 and the valve shaft 94. The single valve shaft 94 is shown extending through the cylinder head 92 of the engine 90, with one of the intake ports 104 and one of the exhaust ports 106 shown. A spark plug port 48 and a fuel injector port 46 extend through the cylinder head 92. A recess 98 is provided in the cylinder head 96 of the engine 90 for rotatably receiving the valve shaft 94 and rotatably mounting the valve shaft 94 to the cylinder head 96 in the recesses 98 (bearings not shown). The recess 98 may have a square shaped cross-section, or other cross-section such as a circular shaped cross-section. The valve shaft 94 is shown with the intake port 104 vertically aligned for blocking air from flowing from the intake manifold 32 through the intake port 104 and into the cylinder 20, and the exhaust port 106 is shown in an open position for passing exhaust gases from the cylinder 20, through the exhaust port 34 and into the exhaust manifold 34. At a later time, the valve shaft 94 may be rotated such that the cylinder 20 is fully sealed, and then rotated again, such that the valve shaft 94 is moved to align the intake port 104 for passing air into the cylinder 20 and to align the exhaust port 106 for blocking exhaust gases from being exhausted from the cylinder 20 into the exhaust manifold 34.

Figure 7:
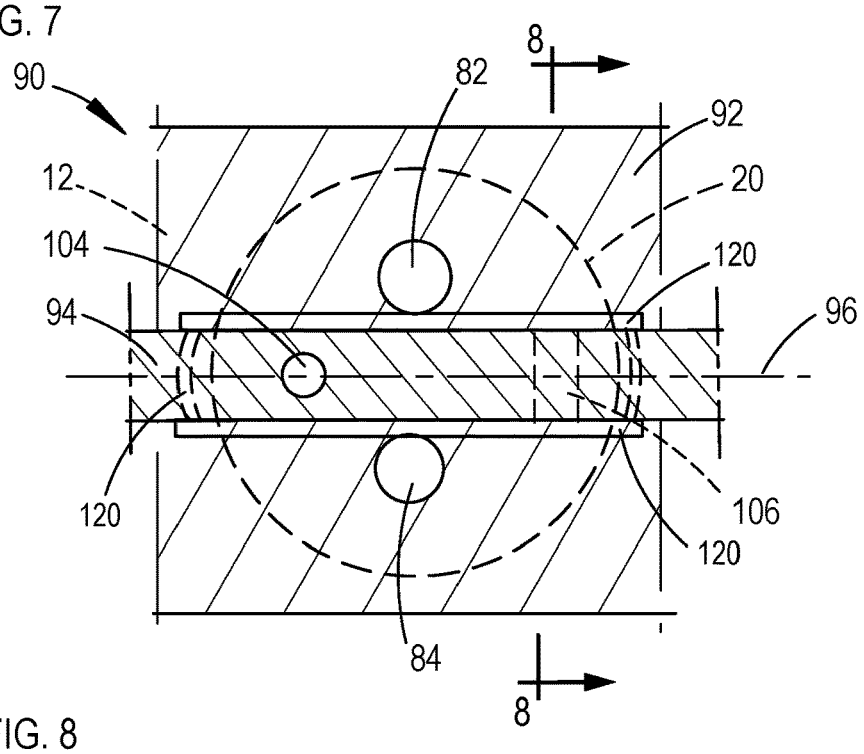

FIG. 7 is a sectional view of a portion of the engine 90 taken along section line 7-7 of FIG. 6 which shows the cylinder head 92, looking downward onto the top of one of the cylinders 20 in the block 12. The valve shaft 94 is shown extending in the cylinder head 92, rotatably mounted to the head 92 (bearings not shown). The valve shaft 94 has a longitudinal axes 96 which preferably extends in parallel to the longitudinal axis 30 of the crankshaft 28. A fuel injector port 82 and a spark plug port 84 are shown extending through the head 92, aligned in a spaced apart relation on opposite sides of the valve shaft 94. The intake port 104 and the exhaust port 106 are shown extending transversely through the valve shaft 94, preferably at right angles to the longitudinal axes 96. The exhaust port 106 is shown in fluid communication with the cylinder 20 and the intake port 104 is shown as being moved aside from being in fluid communication with the cylinder 20.

Figure 8:
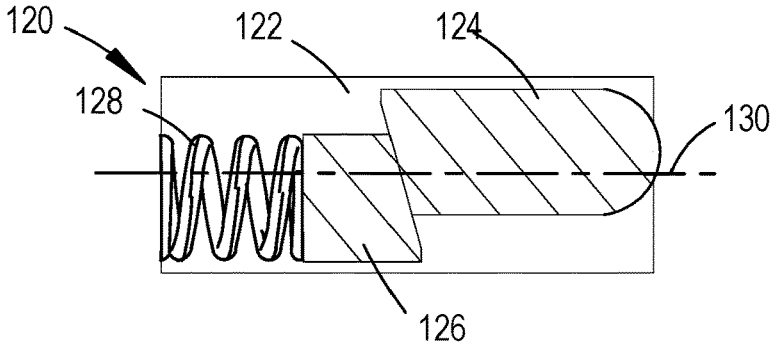

FIG. 8 is an enlarged sectional view of one of the seals 120 show in FIGS. 2, 3 and 7, and taken along section line 8-8 in FIG. 7. The seal 120 seals between the cylinder head 14 and one side of one of the valve shafts 38 and 44. The seal is preferably of an elongate shape as shown in FIG. 7, extending adjacent to the one of the valve shafts 38 and 44. The seal 120 is disposed in a seal gland 122, and has a first seal element 124 has a round protrusion which presses against the side of one of the shafts 38 and 44. A second seal element 126 is disposed adjacent the first seal element 124, on an opposite side of the first seal element 124 from the valve shaft 38, 44. An interface between the first and second seal elements 122 and 124 is angled to a central axis 130, providing movement along the interface for self-alignment of the first seal element 124 with the surface of the one of the shafts 38, 44 it is sealing against. A spring member 128 biases the seal elements 122 and 124. The spring member 128 is shown as a coil spring, and may be multiple coil springs or one or more leaf springs.

Figure 9:
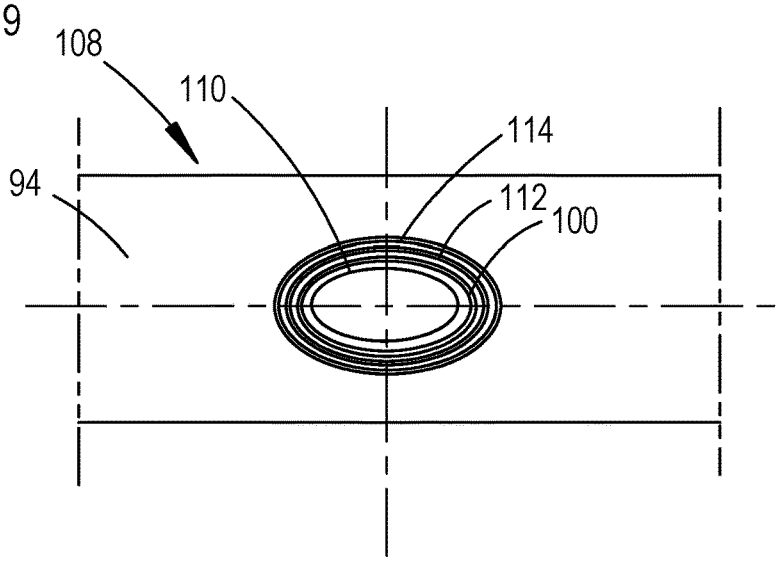

FIG. 9 is side view of a valve shaft having a valve shaft port 110, which is representative of one of the intake ports 50, 104 and the exhaust ports 52, 106. Three seal grooves 78, 80 and 82 concentrically disposed with the valve shaft port 110. The seal grooves 78, 80 and 82 will cooperate with a mating cylinder head surface for preventing flow of gases over the seal grooves 78, 80 and 82. In some embodiments, a single or a double seal groove configuration may be used instead of a triple seal groove configuration shown in FIG. 8. Turbulence from air and gases moving across the seal grooves 78, 80 and 82 will prevent flow across the seal grooves to seal against flow of gases through the valve shaft port 110.

Figure 10:
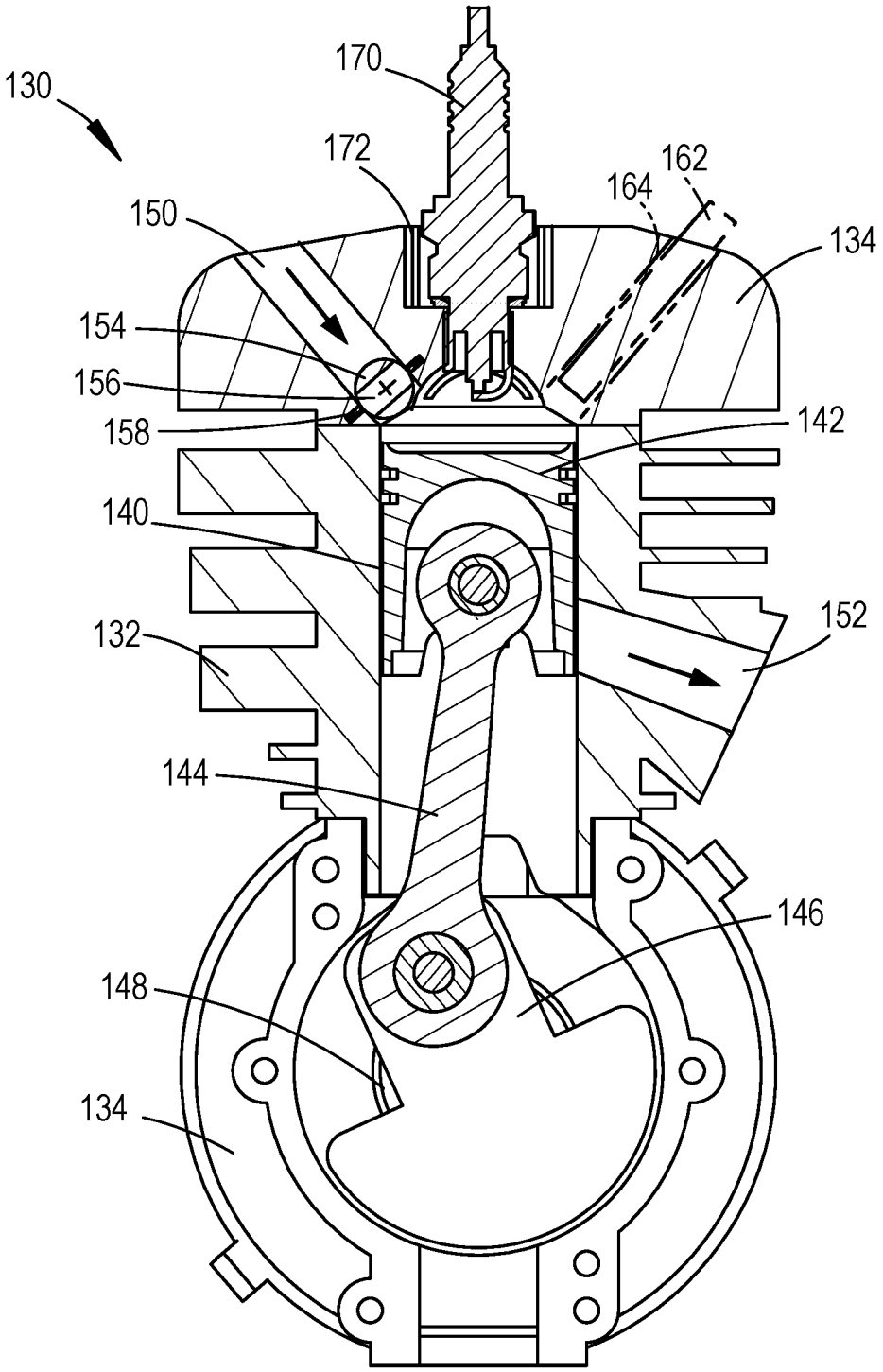
FIG. 10 is a vertical section view of a two stroke internal combustion engine having a rotary valve shaft according to the present disclosure.

FIG. 10 is a vertical section view of a two stroke internal combustion engine 130 having an intake with a ported rotary valve shaft 154 according to the present disclosure. The engine 130 has a block 132, a cylinder head 134 and a crankcase 136. The engine 130 is shown having a single cylinder 140 and a single piston 142 slidably disposed in the cylinder 140. A rod 144 pivotally connects between the piston 142 and a crank arm 146. The crank arm 146 is mounted to a crank shaft 148. An intake port 150 extends through the cylinder head 134 to the cylinder 140. An exhaust port 152 extends from the cylinder 140 and through the block 132. The exhaust port 152 extends from the cylinder 140 at a mid-section of the cylinder 140, vertically at mid-way point of the height of the cylinder 140. The valve shaft 154 is preferably located in the intake port 150 at the end of the intake port 150 which is adjacent the cylinder 140. A flow port 156 extends through the valve shaft 154 for selectively locating in alignment with the intake port 150 for blocking flow through intake port 150 and for passing flow through the intake port 150 and into the cylinder 140. Seals 158, preferably provided by the seals 120 of FIG. 8, are disposed adjacent the valve shaft 154. A control unit and stepper motor (not shown), such as the control unit 56 and the stepper motor 54 of FIGS. 1 and 5, are preferably provided for controlling operation of the valve shaft 154 and the two stroke engine 130, synchronizing the valve shaft 154 and the crank shaft 148. In some embodiments, crank gears, valve shaft sprockets, and timing chains may be used for synchronizing the crank shaft 148 with operation of the valve shaft 154, such as the crank gears 66, valve shaft sprocket 68, and timing chain 72 of FIGS. 1 and 5. Fuel may be passed through the intake port 150 either using a conventional air-fuel carburetor or injecting fuel into air flowing through the intake port 150. In other embodiments, a fuel injector 162 (shown in phantom) and a fuel injector port 164 (shown in phantom) may be provided. A spark plug 170 is shown mounted in a spark plug port 172.

The present invention provides advantages of an internal combustion engine having variable valve timing in which cam timing features are controlled by an electronic control unit which operates one or more stepper motors. Sensors are providing for determining the angular position of the rotary shaft and the angular position of the valve shaft, and then the stepper motor is actuated to accurately position the valve shaft to selectively pass air and exhaust through flow passages formed into the valve shaft, preferably without use of spring actuated intake and exhaust valves which extends the service life of the engine. Preferably, the electronic control unit selectively causes combustion to occur in the combustion chambers such that at mid-range power levels the engine operates in four stroke mode, at low power levels the engine operates in multi-stroke mode greater than four strokes, such as six stroke, eight stroke or ten stroke, and at high power levels the engine operates in two stroke mode, equally utilizing each of the cylinders for combustion in each of the modes. For the different modes, the valve shaft is rotated by the stepper motor at an angular velocity which is proportional to the angular velocity at which the crank shaft rotates. In two stroke mode the valve shaft will rotate at an angular velocity which is equal to the angular velocity of the crank shaft. In four stroke mode the valve shaft is rotated at an angular velocity which is one-half the angular velocity of the crank shaft rotates. In eight stroke mode the valve shaft is rotated at an angular velocity which is one-fourth the angular velocity of the crank shaft. Similar proportions are utilized by the ECU and the stepper motor for the valve shaft angular velocity and the crank shaft angular for six stroke mode, ten stroke mode, twelve stroke mode, and other modes.

Although the preferred embodiment has been described in detail, it should be understood that various changes, substitutions and alterations can be made therein without departing from the spirit and scope of the invention as defined by the appended claims.

What is claimed is:

1. An internal combustion engine comprising:

a combustion chamber;

a power shaft movably secured to said engine for transferring mechanical output power from the engine;

at least one valve shaft rotatably secured to an engine for moving relative to said engine block to define mechanical timing for at least one of intake timing and exhaust timing for said combustion chamber of the engine;

said at least one valve shaft having a flow passage formed there-in for selectively aligning in a first position with one of an engine intake manifold and an engine exhaust manifold and providing fluid communication between said combustion chamber and said one of said engine intake manifold and said engine exhaust manifold, and said at least one valve shaft further configured for moving to a second position and preventing the fluid communication between said combustion chamber and said one of said engine intake manifold and said engine exhaust manifold;

At least one stepper motor operable to selectively rotate said at least one valve shaft into said first position and into said second position, selectively aligning said flow passage for determining said fluid communication between said combustion chamber and said one of said engine intake manifold and said engine exhaust manifold;

sensors located relative to said power shaft and said valve shaft for determining power shaft positions and valve shaft angular positions relative to said power shaft;

an engine control unit connected to said sensors for receiving positions signals from said sensors, and emitting control signals to said at least one stepper motor to move said valve shaft into said angular positions which include said first and second positions;

said engine having a plurality of combustion chambers, one of which comprises said combustion chamber, and wherein said engine control unit is configured for selectively operating only part of said plurality of combustion chambers at low power settings;

wherein said engine control unit emits control signals which move at least said at least one valve shaft to align said one flow passage and additional intake flow passages for passing intake air to said plurality of combustion chambers used at low power settings and which aligns selected other intake flow passages for not passing said intake air to ones of said plurality of combustion chambers not being utilized for combustion during lower power settings;

wherein said engine control unit controls fuel injection into said plurality of combustion chambers, and emits control signals to inject fuel into said part of said plurality of combustion chambers used at low power settings and which does not inject fuel into selected ones of said plurality of combustion chambers not being utilized for combustion during lower power settings; and wherein said engine control unit controls ignition in said engine and emits signals which selectively causes combustion to occur in said plurality of combustion chambers such that at low power settings said engine operates in multi-stroke mode greater than four strokes and at high power said engine operates in two stroke mode, equally utilizing each of said cylinders for combustion.

2. The internal combustion engine according to claim 1, wherein said at least one valve shaft has a solid body and said flow passage is a borehole which extends transversely through said solid body.

3. The internal combustion engine according to claim 1, wherein said valve shafts has a longitudinal axis about which it rotates, said flow passage comprises an intake passage, and said valve shafts further comprises an exhaust flow passage which is angularly aligned at an angle to said intake passage relative to said longitudinal axis of said valve shaft.

4. The internal combustion engine according to claim 3, wherein seal grooves for formed into said valve shafts to extend around respective ones of said intake and exhaust flow passages, and, when respective ones of said intake passage and said exhaust flow passage are selectively aligned for preventing fluid communication with said combustion chamber and respective ones of said intake and said exhaust, respective ones of said seal grooves provide turbulence to prevent fluid communication there-between.

5. The internal combustion engine according to claim 4, wherein said seal grooves are disposed to concentrically extend around respective ones of said intake passage and said exhaust flow passage.

6. An internal combustion engine having an engine block with a plurality of combustion chambers comprising:

a head mounted to said engine block and adjacent to the plurality combustion chambers;

a rotary power shaft rotatably secured to said engine block for transferring power therefrom;

a first valve shaft rotatably secured to said head, said at least one first valve shaft being formed into an elongate cylindrical shape having a longitudinal axis extending through said cylindrical shape and about which said at least one first valve shaft rotates;

said first valve shaft further having intake flow passages which extend through said first valve shaft in transverse relation to said longitudinal axis, wherein said intake flow passages are formed there-in for selectively aligning with a respective engine intake and corresponding combustion chambers for selectively passing intake air from said engine intake through said intake flow passages and into said corresponding combustion chambers, a second valve shaft rotatably secured to said head, said second valve shaft being formed into a second elongate cylindrical shape having a second longitudinal axis extending through said second cylindrical shape and about which said second valve shaft rotates;

said second valve shaft further having exhaust flow passages which extend through said second valve shaft in transverse relation to said second longitudinal axis, wherein said exhaust flow passages are formed there-in for selectively aligning with respective an engine exhaust and respective plurality of combustion chambers for selectively passing exhaust gases from said respective plurality of combustion chambers through said exhaust flow passages and to said engine exhaust;

one or more stepper motors for moving said first valve shaft and said second valve shaft to angularly align respective ones of said intake flow passages and said exhaust flow passages with said combustion chambers and said engine intake and said engine exhaust;

sensors located relative to said rotary power shaft and said first and second valve shafts for determining rotary power shaft positions and first and second valve shafts angular positions; and an engine control unit connected to said sensors for receiving positions signals from said sensors, and emitting control signals to said stepper motor for electronically controlling angular positions of said first and second valve shafts;

said engine having the plurality of combustion chambers, one of which comprises said combustion chamber, and wherein said engine control unit is configured for selectively operating only part of said combustion chambers at low power settings;

wherein said engine control unit emits control signals which move at least said valve shaft to align said one flow passage and additional intake flow passages for passing intake air to said plurality of combustion chambers used at low power settings and which aligns selected other intake flow passages for not passing said intake air to ones of said plurality of combustion chambers not being utilized for combustion during lower power settings;

wherein said engine control unit controls fuel injection into said plurality of combustion chambers, and emits control signals to inject fuel into said part of said plurality of combustion chambers used at low power settings and which does not inject fuel into selected ones of said plurality of combustion chambers not being utilized for combustion during lower power settings; and wherein said engine control unit controls ignition in said engine and emits signals which selectively causes combustion to occur for in said plurality of combustion chambers such that at low power settings said engine operates in multi-stroke mode greater than four strokes and at high power said engine operates in two stroke mode, equally utilizing each of said cylinders for combustion.

7. The internal combustion engine according to claim 6, wherein seal grooves for formed into each of said first and second valve shafts to circumferentially extend around respective ones of said intake and exhaust flow passages, and said seal grooves prevent flow through respective ones of said intake flow passages and said exhaust flow passages when said respective ones of said intake and exhaust flow passages are disposed in said second positions.

8. The internal combustion engine according to claim 6, further comprising at least one electrically controlled clutch mounted to one of said rotary shaft and said first valve shaft and connected by a timing chain to the other of said rotary shaft and said second valve shaft, wherein said at least one electrically controlled clutch is actuated to provide valve shaft timing in alternative to said electronic control unit and said one or more stepper motor.

9. An internal combustion engine comprising:

a combustion chamber;

a power shaft movably secured to said engine for transferring mechanical output power from the engine;

at least one valve shaft rotatably secured to said engine for moving relative to said engine block to define mechanical timing for at least one of intake and exhaust for said combustion chamber of the engine;

said at least one valve shaft having a flow passage formed there-in for selectively aligning in a first position with one of an engine intake manifold and an engine exhaust manifold and providing fluid communication between said combustion chamber and said one of said engine intake manifold and said engine exhaust manifold, and said at least one valve shaft further configured for moving to a second position and preventing the fluid communication between said combustion chamber and said one of said engine intake manifold and said engine exhaust manifold;

at least one a stepper motor operable to selectively rotate said at least one valve shaft into said first position and into said second position, selectively aligning said flow passage for determining said fluid communication between said combustion chamber and said one of said engine intake manifold and said engine exhaust manifold;

sensors located relative to said power shaft and said at least one valve shaft for determining power shaft positions and valve shaft angular positions relative to said power shaft;

an engine control unit connected to said sensors for receiving positions signals from said sensors, and emitting control signals to said at least one stepper motor to move said at least one valve shaft into said angular positions which include said first and second positions; and at least one electrically controlled clutch mounted to one of said power shaft and said at least one valve shaft and connected by a timing chain to the other of said power shaft and said valve shaft, wherein said at least one electrically controlled clutch is actuated to provide valve shaft timing in alternative to said electronic control unit and said at least one stepper motor.

10. The internal combustion engine according to claim 9, wherein said at least one valve shaft has a solid body and said flow passage is a borehole which extends transversely through said solid body.

11. The internal combustion engine according to claim 9, wherein said at least one valve shaft has a longitudinal axis about which it rotates, said flow passage comprises an intake passage, and said at least one valve shaft further comprises an exhaust flow passage which is angularly aligned at an angle to said intake passage relative to said longitudinal axis of said at least one valve shaft.

12. The internal combustion engine according to claim 11, wherein seal grooves for formed into said at least one valve shaft to extend around respective ones of said intake and exhaust flow passages, and, when respective ones of said intake passage and said exhaust flow passage are selectively aligned for preventing fluid communication with said combustion chamber and respective ones of said intake and said exhaust, respective ones of said seal grooves provide turbulence to prevent fluid communication there-between.

13. The internal combustion engine according to claim 12, wherein said seal grooves are disposed to concentrically extend around respective ones of said intake passage and said exhaust flow passage.

14. The internal combustion engine according to claim 9, further comprising said engine having the plurality of combustion chambers, one of which comprises said combustion chamber, and wherein said engine control unit is configured for selectively operating only part of said combustion chambers at low power settings.

15. The internal combustion engine according to claim 14, wherein said engine control unit emits control signals which move at least said at least one valve shaft to align said one flow passage and additional intake flow passages for passing intake air to said plurality of combustion chambers used at low power settings and which aligns selected other intake flow passages for not passing said intake air to ones of said plurality of combustion chambers not being utilized for combustion during lower power settings.

16. The internal combustion engine according to claim 15, wherein said engine control unit controls fuel injection into said plurality of combustion chambers, and emits control signals to inject fuel into said part of said plurality of combustion chambers used at low power settings and which does not inject fuel into selected ones of said combustion chambers not being utilized for combustion during lower power settings.

17. The internal combustion engine according to claim 15, wherein said engine control unit controls ignition in said engine and emits signals which selectively causes combustion to occur in said plurality combustion chambers such that at low power settings said engine operates in multi-stroke mode greater than four strokes and at high power said engine operates in two stroke mode, equally utilizing each of said cylinders for combustion.

* * * * *